US008316595B2

(12) United States Patent
Burford et al.

(10) Patent No.: US 8,316,595 B2
(45) Date of Patent: Nov. 27, 2012

(54) COLLAPSIBLE STAIRCASE

(76) Inventors: Tyrus S. Burford, Niceville, FL (US); Evan T. Quinley, Knoxville, TN (US)

( * ) Notice: Subject to any disclaimer, the term of this patent is extended or adjusted under 35 U.S.C. 154(b) by 161 days.

(21) Appl. No.: 12/754,987

(22) Filed: Apr. 6, 2010

(65) Prior Publication Data

US 2011/0239556 A1 Oct. 6, 2011

(51) Int. Cl.
*E04F 11/035* (2006.01)

(52) U.S. Cl. ..... 52/183; 52/188

(58) Field of Classification Search ..... 52/182, 52/183, 188, 191; 182/93, 95, 195; 244/129.6
See application file for complete search history.

(56) References Cited

U.S. PATENT DOCUMENTS

| | | | | |
|---|---|---|---|---|
| 595,453 | A * | 12/1897 | Fischer | 182/195 |
| 2,933,149 | A | 4/1960 | Lee | |
| 3,367,444 | A | 2/1968 | Meddick | |
| 3,408,959 | A | 11/1968 | Cripe et al. | |
| 3,713,511 | A | 1/1973 | Hinkle | |
| 3,871,479 | A | 3/1975 | Pelto | |
| 3,885,365 | A | 5/1975 | Cox | |
| 3,906,690 | A | 9/1975 | Miriani | |
| 3,962,838 | A | 6/1976 | Cox | |
| 4,079,815 | A * | 3/1978 | Cormier | 182/195 |
| 4,091,893 | A | 5/1978 | Neal | |
| 4,406,347 | A | 9/1983 | Stathopulos | |
| 4,586,585 | A | 5/1986 | Zaner | |
| 4,615,160 | A | 10/1986 | LeBlond | |
| 4,631,880 | A | 12/1986 | Leicht | |
| 4,642,953 | A | 2/1987 | DeGood | |
| 4,711,282 | A | 12/1987 | Frazier et al. | |
| 5,005,850 | A | 4/1991 | Baughman | |
| 5,085,020 | A | 2/1992 | Yamazaki | |
| 5,143,324 | A | 9/1992 | Cornelius et al. | |
| 5,454,196 | A | 10/1995 | Gaines et al. | |
| 6,810,995 | B2 | 11/2004 | Warford | |
| 6,868,944 | B2 | 3/2005 | Truckner et al. | |
| 2005/0284043 | A1 * | 12/2005 | Sorenson, Jr. | 52/182 |
| 2007/0084670 | A1 * | 4/2007 | Parker | 182/195 |
| 2009/0188444 | A1 | 7/2009 | Whalen | |

FOREIGN PATENT DOCUMENTS

| | | |
|---|---|---|
| WO | 9523907 | 9/1995 |

OTHER PUBLICATIONS

Werner's Televator Telescoping Attic Ladder, Installation Instructions, 2007, www.wernerladder.com.

* cited by examiner

*Primary Examiner* — Mark Wendell
*Assistant Examiner* — Matthew J Smith
(74) *Attorney, Agent, or Firm* — Luedeka Neely Group, P.C.

(57) ABSTRACT

Embodiments of the invention described herein pertain to a collapsible staircase comprising a plurality of tread assemblies. Each tread assembly is disposed adjacent to at least one of another of the tread assemblies and includes a tread plate and a first and a second telescoping support member attached to a rear surface of the tread plate. The first and second telescoping support members of each tread assembly are operable to slideably engage the telescoping support members of the adjacent tread assemblies for adjusting a height of the staircase and for defining a substantially fixed angle between the tread plates of each of the tread assemblies.

5 Claims, 13 Drawing Sheets

COLLAPSIBLE STAIRCASE

FIELD

This invention relates generally to a collapsible staircase. More specifically, this invention relates to a collapsible staircase having a plurality of tread plates disposed along the staircase at a substantially fixed angle and that are operable to collapse independently of each other.

BACKGROUND

Extension ladders have been commonly used for many years to reach greater heights such as the roof of a house. Common extension ladders generally are only divided into two or three extendable pieces. To have an extension ladder with a sizeable extended length, the ladder must be fairly bulky and long even when the ladder is in a collapsed position. Thus, one disadvantage of the common extension ladder is that they are difficult to transport from one project to another and require a greater amount of space in storage and/or during transport than is desirable.

Another major disadvantage with a ladder is that the climbing motion of the user is unsafe. There are thousands of injuries and many deaths each year that result from people falling off ladders. Many of these injuries and deaths could be avoided if the person was using a staircase instead of a ladder due to the more ergonomic climbing motion involved in using a staircase. One of the major reasons why staircases are safer than ladders includes the fact that stairs generally provide a smaller rise over run than ladders. This helps to prevent a user from falling backwards, which is how most injuries occur.

Staircases, however, suffer the disadvantage that they generally require significant space and permanent installation at a desired location. Thus, staircases are not able to be transported to various locations quickly like an extension ladder. For example, a typical homeowner would usually choose the common household ladder to do various tasks around the house, such as cleaning leaves from the gutters, because he would not take the time to install a staircase each time he needed a ladder to gain access to a location at his home. Examples of other applications where a ladder is often used instead of a staircase due to the ladder's portable nature are at construction sites, fire escapes, and unloading cargo and deboarding from trucks and other large vehicles.

Accordingly, it is desirable to provide a collapsible staircase that is operable to be collapsed into a compact position for easy storage and transportation. Also, there is a need for increasing the safety of a portable extension ladder by providing a staircase that is able to be collapsed into a compact position and easily installed at a desired location.

SUMMARY

Embodiments of the invention described herein pertain to a collapsible staircase. In one embodiment, the collapsible staircase includes a plurality of tread assemblies, each tread assembly being disposed adjacent to at least one of another of the tread assemblies. The plurality of tread assemblies each include a tread plate and a first and a second telescoping support member attached to a rear surface of the tread plate and along the width of the tread plate. The first and second telescoping support members of each tread assembly are operable to slideably engage the telescoping support members of the adjacent tread assemblies for adjusting a height of the staircase and for defining a substantially fixed angle between the tread plates of each of the tread assemblies. Each of the first and second telescoping support members may also include a tread plate support member for attaching the first and second telescoping support members to the tread plate. In preferred embodiments, each of the tread plates are operable to collapse independently of any of the other tread plates so that the height of the staircase is incrementally adjustable. In some embodiments, each of the first and second telescoping support members include a spring loaded detent disposed on an inside surface of the telescoping support members, the spring loaded detents for removeably locking the plurality of tread assemblies so that each tread assembly is operable to collapse independently of another one of the tread plates.

According to some embodiments of the collapsible staircase, each of the first and second telescoping support members have a male engaging surface and a female receiving surface for slideably engaging the adjacent tread assemblies. A plurality of the tread plates may include slots for inserting a handrail. The handrail may have a plurality of legs, the plurality of legs for inserting into the slots of the tread plates for removeably fixing the handrail to the staircase. A first and a second leveling mechanism may be provided for attaching to one of the first and second telescoping support members of a bottom tread assembly. The first and second leveling mechanisms are operable to adjust a length of at least one of a first side of the staircase and a second side of the staircase. The plurality of tread assemblies may also include a top tread assembly and the staircase further includes a mounting assembly for securing the staircase to a desired location, the mounting assembly including a first and a second support attachment for engaging respective first and second telescoping support members of the top tread assembly, the first and second support attachments being attachable to a mounting bracket disposed adjacent the desired location. The mounting assembly may also include a mounting support for securing adjacent the desired location and beneath the first and second telescoping support members of the top tread assembly.

In another embodiment of the invention, a collapsible staircase is provided having a first tread assembly repeating pattern. The first tread assembly repeating pattern includes a first tread assembly having a first tread plate and a first pair of telescoping support members attached to a rear surface of the first tread plate, a second tread assembly having a second tread plate and a second pair of telescoping support members attached to a rear surface of the second tread plate for slideably engaging the first pair of telescoping support members so that the height of the second tread plate is adjustable with respect to the first tread plate, and a third tread assembly having a third tread plate and a third pair of telescoping support members attached to a rear surface of the third tread plate for slideably engaging the second pair of telescoping support members so that the height of the third tread plate is adjustable with respect to the second tread plate. The first tread assembly repeating pattern has a height that is incrementally adjustable and defines a substantially fixed angle between the tread plates of each of the tread assemblies.

According to this embodiment, the collapsible staircase may also include a second tread assembly repeating pattern having a fourth tread assembly. The fourth tread assembly includes a fourth tread plate and a fourth pair of telescoping support members attached to a rear surface of the fourth tread plate. A connecting tread assembly is provided for connecting the first tread assembly repeating pattern to the second tread assembly repeating pattern. The connecting tread assembly includes a connecting tread plate, a fifth pair of first and second telescoping support members attached to a rear surface of the connecting tread plate for slideably engaging the third pair of telescoping support members of the third tread assembly so that the height of the connecting tread plate is adjustable with respect to the third tread plate, and a sixth pair of first and second telescoping support members attached to the rear surface of the connecting tread plate for slideably engaging the fourth pair of telescoping support members of the fourth tread assembly so that the height of the fourth tread plate is adjustable with respect to the connecting tread plate. The first tread assembly repeating pattern and second tread assembly repeating pattern has a height that is incrementally adjustable and defines a substantially fixed angle between the tread plates of each of the tread assemblies when connected by the connecting tread assembly.

In other embodiments of the invention, each of the pairs of first and second telescoping support members are disposed along a width of the tread plates and each of the first and second telescoping support members include a tread plate support member for attaching the first and telescoping support members to the tread plate. Each of the first and second telescoping support members may have a male engaging surface and a female receiving surface for slideably engaging the first and second telescoping support members of an adjacent tread assembly. Each of the first and second telescoping support members may also include a spring loaded detent disposed on an inside surface of the telescoping support members, the spring loaded detents for removeably locking the plurality of tread assemblies so that each tread assembly is operable to collapse independently of another one of the tread plates.

In another aspect, the first tread assembly repeating pattern may include a top tread assembly having a top pair of telescoping support members and the collapsible staircase includes a mounting assembly for securing the staircase to a desired location. The mounting assembly includes a first and a second support attachment for engaging the top pair of first and second telescoping support members of the top tread assembly, the first and second support attachments being attachable to a mounting bracket disposed adjacent the desired location.

In yet another embodiment of the invention, a collapsible staircase that is independently moveable from a first location to a second location is provided. The collapsible staircase of this embodiment includes a plurality of tread assemblies slideably connected so that each tread assembly is disposed adjacent to at least one of another of the tread assemblies. Each tread assembly includes a tread plate and a first and a second telescoping support member attached to a rear surface of the tread plate. The first and second telescoping support members of each tread assembly are operable to slideably engage the telescoping support members of the adjacent tread assemblies for incrementally adjusting a height of the staircase where each tread plate is operable to collapse independently of another one on the plurality of tread assemblies and for defining a substantially fixed angle between the tread plates of each of the tread assemblies.

In this embodiment, the collapsible staircase may also include a tread plate support member for attaching each of the first and second telescoping support members to the tread plate, the tread plate support members being disposed at least partially on the underside of the tread plates. A first and a second leveling mechanism are each attached to one of the first and second telescoping support members of a bottom tread assembly for adjusting a length of at least one of a first side of the staircase and a second side of the staircase.

BRIEF DESCRIPTION OF THE DRAWINGS

Further advantages of the invention are apparent by reference to the detailed description in conjunction with the figures.

DETAILED DESCRIPTION

Figure 1:
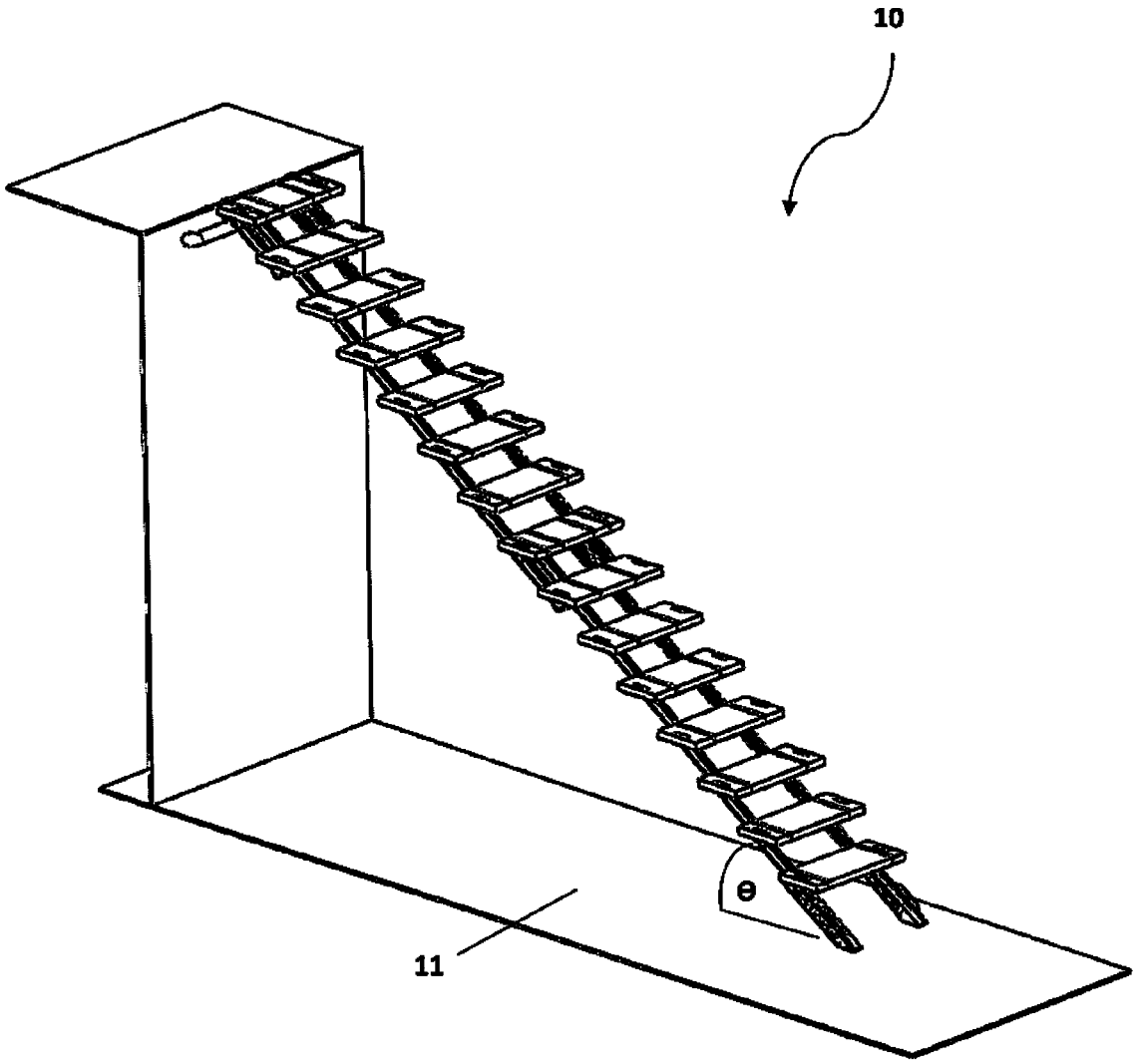
FIG. 1 depicts a perspective view of a fully extended staircase according to one embodiment of the present invention.
Figure 2:
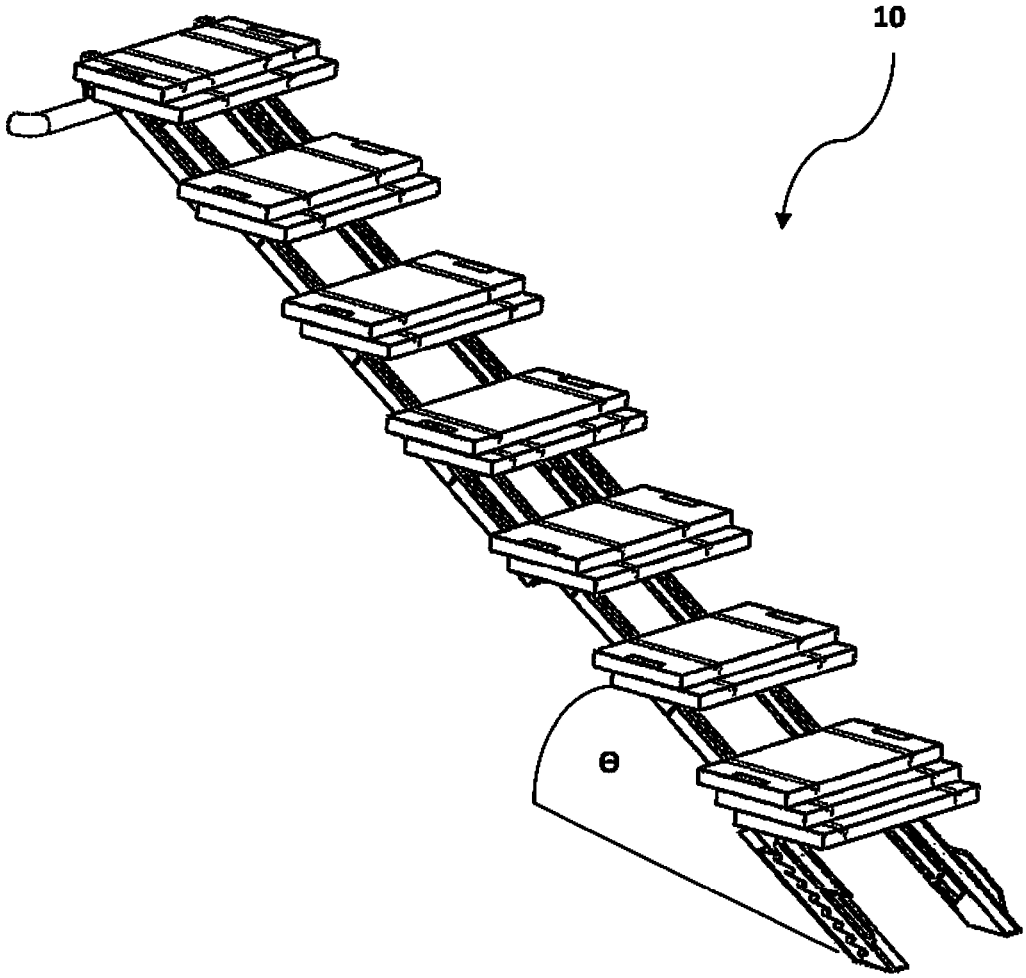
FIG. 2 depicts a perspective view of a partially collapsed staircase according to one embodiment of the present invention.
Figure 3:
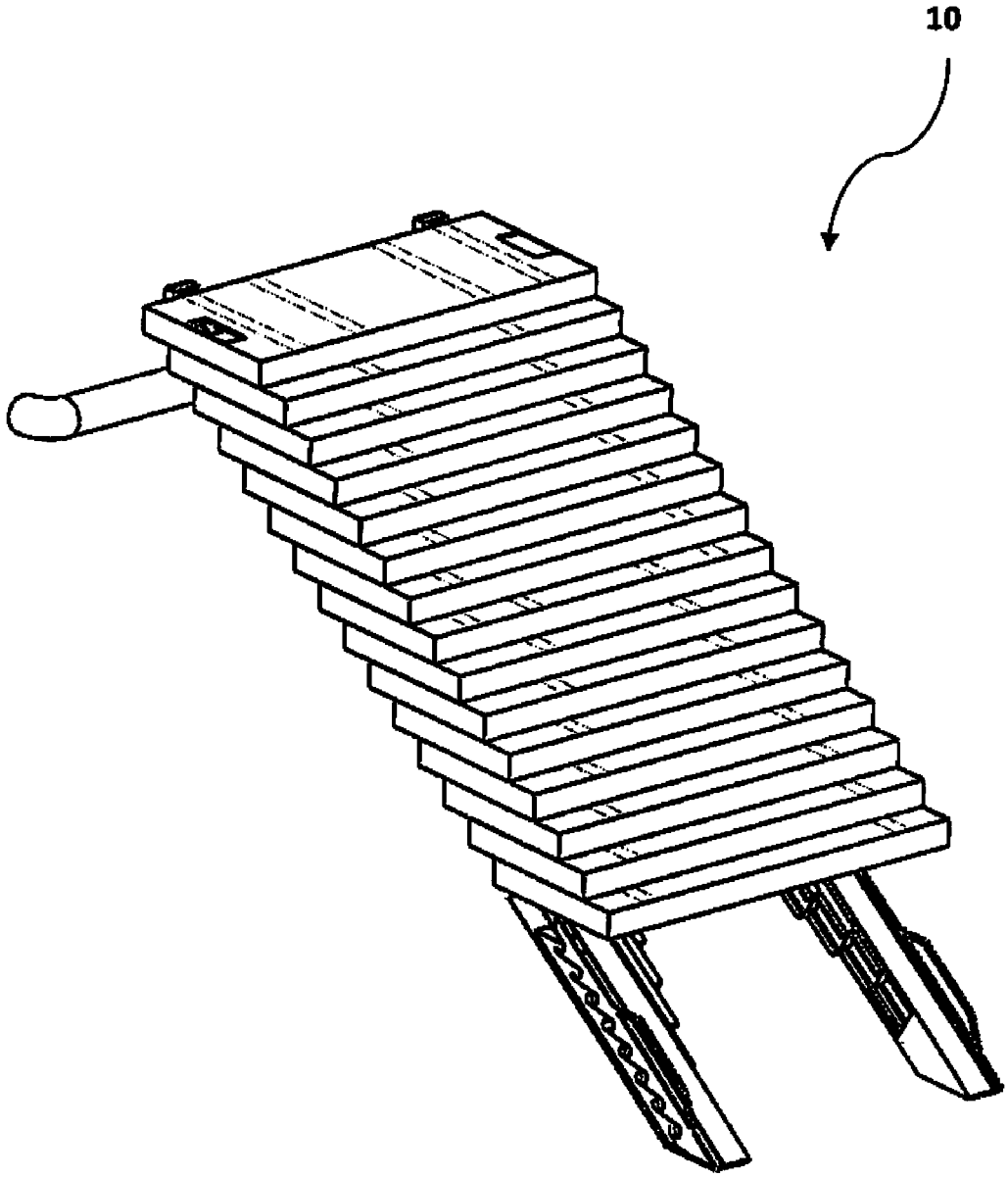
FIG. 3 depicts a perspective view of a fully collapsed staircase according to one embodiment of the present invention.

Referring to FIGS. 1-3, a collapsible staircase 10 is shown in an extended position (FIG. 1), a partially collapsed position (FIG. 2), and a fully collapsed position (FIG. 3). While only three positions are shown in FIGS. 1-3, the collapsible staircase 10 is incrementally adjustable to any number of different heights. Furthermore, no matter what the desired height of the staircase 10, the angle θ between the ground surface 11 and each of the treads of the staircase 10 will remain substantially fixed as explained further below.

Figure 4A:
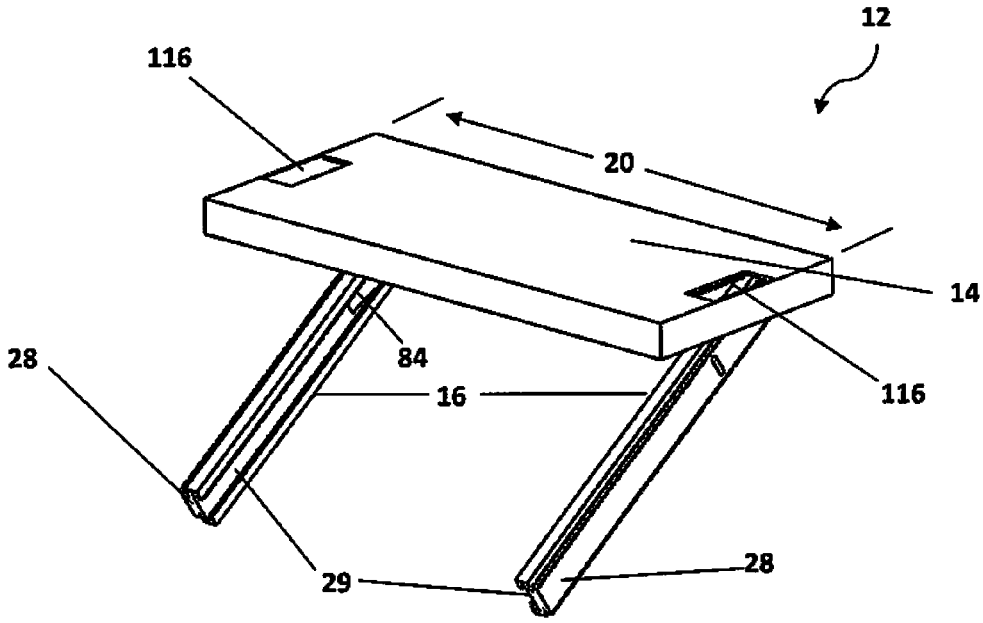
FIG. 4A depicts a front perspective view of a single tread assembly according to one embodiment of the present invention.
Figure 4B:
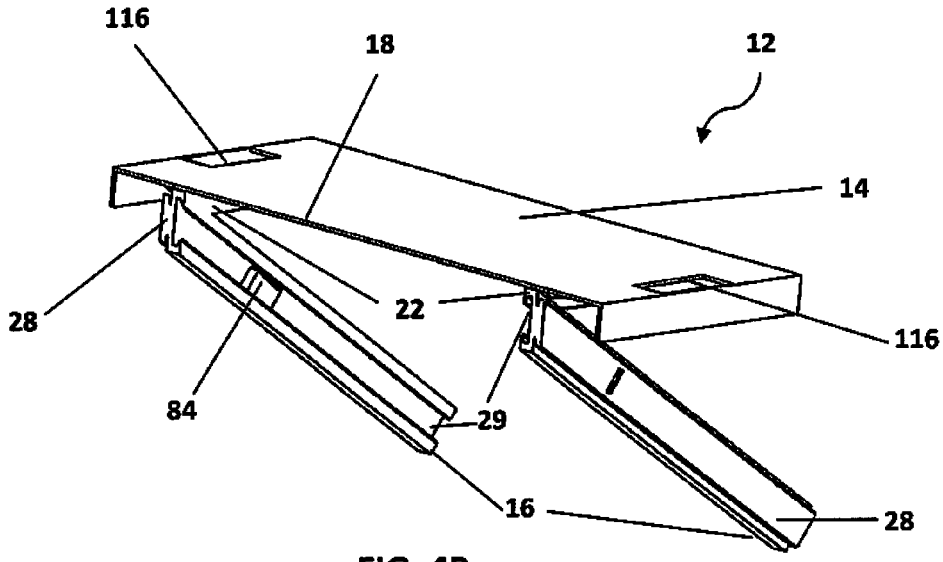
FIG. 4B depicts a rear perspective view of a single tread assembly according to one embodiment of the present invention.
Figure 5:
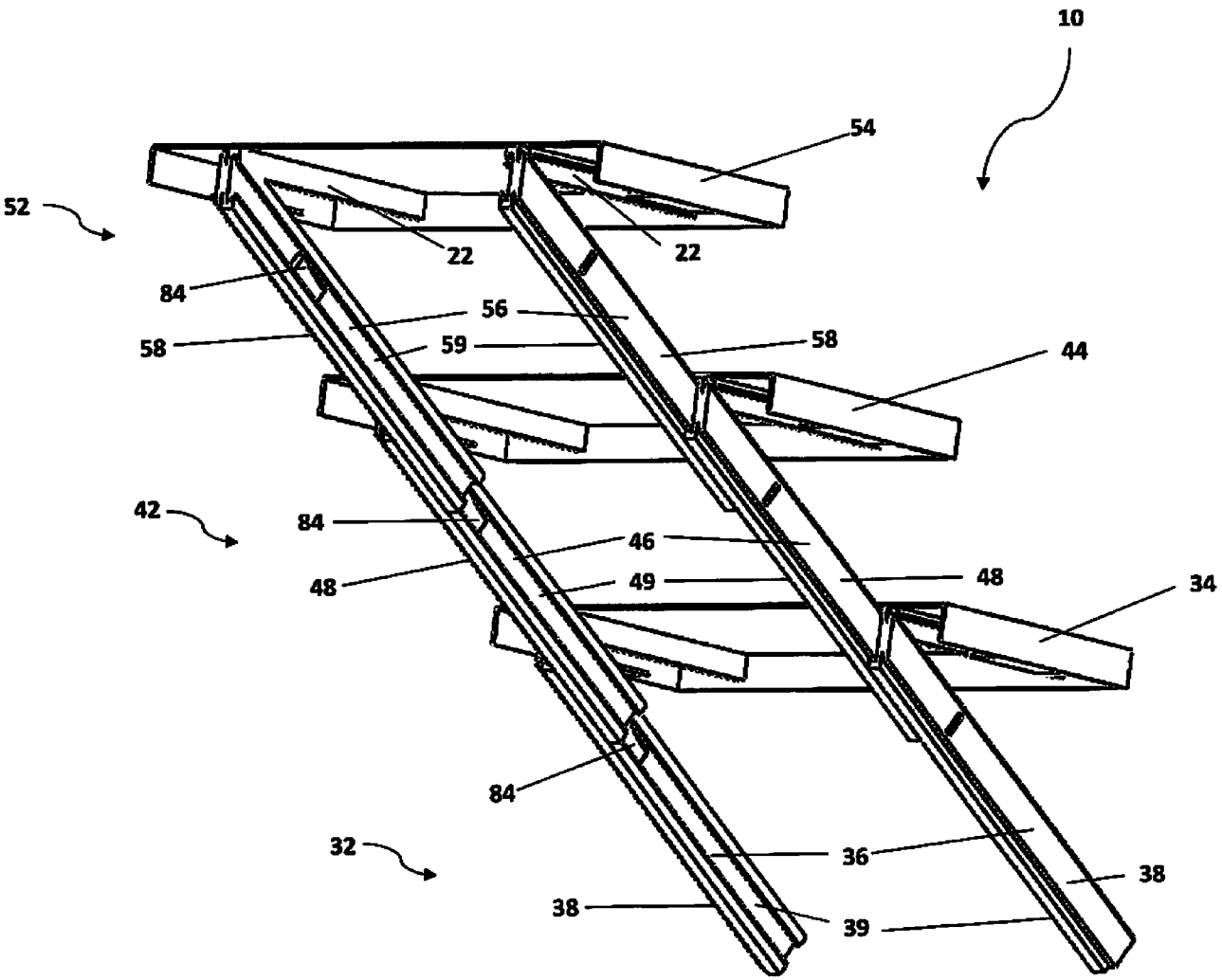
FIG. 5 depicts a rear perspective view of a first, second, and third tread assembly slideably connected according to one embodiment of the present invention.

The collapsible staircase 10 includes a plurality of slideably connected tread assemblies 12. A single tread assembly 12 is shown in FIGS. 4A and 4B. Each tread assembly 12 includes a tread plate 14 and a pair of first and second telescoping support members 16 attached to the rear surface 18 of the tread plate 14. In preferred embodiments, the telescoping support members 16 are disposed along a width 20 of the tread plate 14, as opposed to along the sides of the tread plate 14, to minimize the size of the staircase 10 and provide more support to the tread plate 14. The tread assembly 12 may also include a pair of tread plate support members 22 for attaching the telescoping support members 16 to the tread plate 14. Each of the tread plate support members 22 are preferably connected to each of the telescoping support members 16 as one unitary piece and attached to the underside of the tread plate 14 (FIG. 5 provides another view of the underside of a tread plate 54 having attached tread plate support members 22).

By including the telescoping support members 16 along the width 20 of each tread plate 14, the overall width of the staircase 10 is defined by the width 20 of the tread plates 14 instead of by the distance the telescoping support members 16 extend from the side of a staircase. Further, the staircase 10 of the present invention is able to be the same width at its top as it is at its bottom and is able to be collapsed into a more compact position. In alternate embodiments, some of the telescoping support members 16, or a portion of the telescoping support members 16, of staircase 10 may be disposed along the side of the tread plates 14 and the remaining telescoping support members 16 are disposed along the width 20 of the tread plates 14. In this embodiment, the total width of the staircase 10 is defined by the farthest distance any of the telescoping support members 16 extends from the side of the staircase 10, but the staircase is still more compact because a plurality of the telescoping support members 16 are disposed underneath the tread plates 14.

While the telescoping support members 16 may include any of the features known in the art for providing a sliding connection, each of the telescoping support members of the present invention preferably include a male engaging surface 28 and a female receiving surface 29. As shown in FIGS. 4A and 4B, the male engaging surface 28 are disposed on the outside surfaces of the telescoping support members 16 and the female receiving surfaces 29 are disposed on the inside surfaces of the telescoping support members 16. However, in other embodiments, the male engaging surfaces 28 could be disposed on the inside surface and the female receiving surfaces 29 could be disposed on the outside surface. Further, whenever it is described herein that a male engaging surface 28 engages a female receiving surface 29, it should be understood that the female receiving surface 29 is also engaging the male engaging surface 28.

In preferred embodiments the tread plates 14 and telescoping support members 16 may be constructed of common suitable materials such as steel, fiberglass, or composite plastic, but they are most preferably constructed of a suitable grade of aluminum due to its light weight.

Referring to FIG. 5, a partial rear view of the collapsible staircase 10 is shown having three slideably connected tread assemblies each similar to the tread assembly 12 that was depicted in FIG. 4. Each of the first and second telescoping support members of the first tread assembly 32, second tread assembly 42, and third tread assembly 52 slideably engage the telescoping support members of at least one adjacent tread assembly. Adjacent tread assemblies are the tread assemblies directly below and/or directly above the particular tread assembly. For example, the first tread assembly 32 is shown having the second tread assembly 42 as a top adjacent tread assembly. The second tread assembly 42 has both a bottom adjacent tread assembly, the first tread assembly 32, and a top adjacent tread assembly, the third tread assembly 52, as its adjacent tread assemblies.

The first tread assembly 32 has a first tread plate 34 and a first pair of telescoping support members 36. Each of the telescoping support members 36 includes a male engaging surface 38 and a female receiving surface 39. The second tread assembly 42 includes a second tread plate 44 and a second pair of first and second telescoping support members 46. Each of the telescoping support members 46 includes a male engaging surface 48 and a female engaging surface 49. The second pair of telescoping support members 46 is operable to slideably engage the first pair of telescoping support members 36 so that the height of the second tread plate 44 is adjustable with respect to the first tread plate 34. In this embodiment, the male engaging surfaces 48 of the second tread assembly 42 engage the female receiving surfaces 39 of the first tread assembly 32. A third tread assembly 52 has a third tread plate 54 and a third pair of first and second telescoping support members 56. Each of the telescoping support members 56 includes a male engaging surface 58 and a female engaging surface 59. The third pair of telescoping support members 56 is operable to slideably engage the second pair of telescoping support members 46 so that the height of the third tread plate 54 is adjustable with respect to the second tread plate 44. As shown, the male engaging surfaces 58 of the third tread assembly 52 engage the female receiving surfaces 49 of the second tread assembly 42.

While the tread assemblies 42 and 52 have been shown and described as having their male engaging surfaces 48 and 58 engage the female receiving surfaces 39 and 49, respectively, of the adjacent tread assemblies below them, it should be understood that the assemblies can be modified so that the female receiving surfaces 49 and 59 could engage the male engaging surfaces 38 and 58, respectively.

As shown in FIGS. 1 and 2, a plurality of tread assemblies 12 are slideably connected as explained with regards to the first tread assembly 32, second tread assembly 42, and third tread assembly 52 of FIG. 5 to make staircase 10. Having the plurality of tread assemblies 12 connected using the telescoping support members 16 in the above manner allows the height of staircase 10 to be incrementally adjustable because each tread plate 14 is operable to collapse independently of another one of tread plates. The telescoping support members 16 also define a substantially fixed angle θ between each the tread plates 14 and the ground surface 11 that is independent of the desired height of the staircase 10. In other words, as opposed to other ladders and staircases known in the art, a user of staircase 10 changes the height of the staircase 10 by extending any one of the tread assemblies 12 instead of adjusting the angle with which the staircase 10 is positioned against a wall, roof, or other desired location. However, the substantially fixed angle θ can be modified so that the staircase 10 can have any number of desired rise over run configurations by modifying the angle by which the telescoping support members 16 of the plurality of tread assemblies 12 are slideably connected.

Figure 6A:
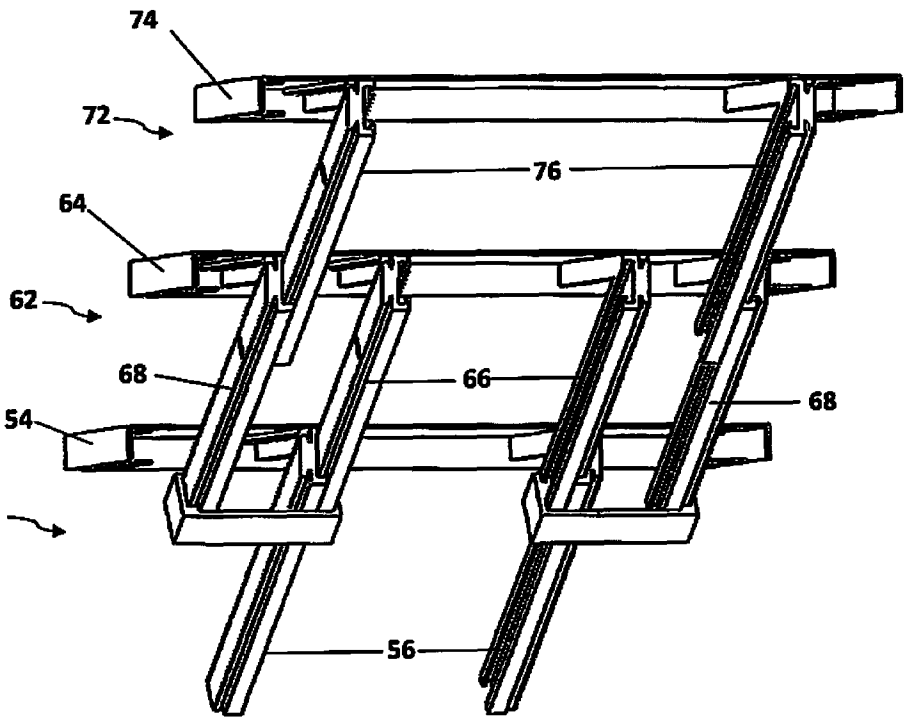
FIG. 6A depicts an exploded perspective view of the connecting tread assembly of FIG. 6 according to one embodiment of the present invention.
Figure 6:
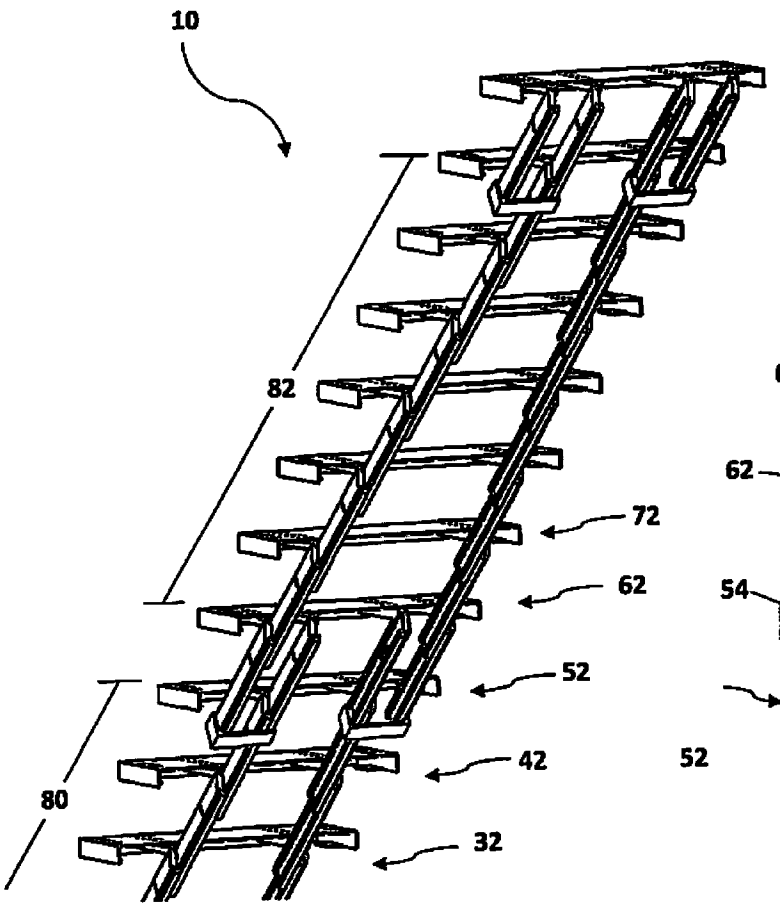
FIG. 6 depicts a partial rear perspective view of a collapsible staircase according to one embodiment of the present invention.

Referring to FIG. 6, the first tread assembly 32, second tread assembly 42, and third tread assembly 52 are included in a first repeating pattern 80 of slideably connected tread assemblies 12 that make up the collapsible staircase 10. The repeating pattern 80 may include numerous tread assemblies 12 other than just the representative tread assemblies identified. As shown in FIGS. 4-6, the telescoping support members 16 of each of the plurality of tread assemblies 12 are disposed toward the side of the tread plates 14 but progressively move inward towards the middle of the tread plates 14 as more tread assemblies 12 are added to the repeating pattern. In an alternate embodiment (not shown), the telescoping support members 16 may start towards the middle of the tread plate 14 and progressively move outwards as more tread assemblies 12 are added.

A second repeating pattern 82 of slideably connected tread assemblies may also be added to the first repeating pattern 80 to increase the length of the staircase 10. Other advantages of adding a second repeating pattern 82 instead of merely adding additional tread assemblies 12 to the first repeating pattern 80 include providing more support to the staircase 10 and restarting the location along the width 20 of the tread plate 14 where the telescoping support members 16 are disposed. As explained above and as shown in FIG. 6, the telescoping support members 16 of the first repeating pattern begin towards the side of the tread plate and progressively move inward. By providing a second repeating pattern 82 of tread assemblies 12, the telescoping support members 16 can again begin towards the sides of the tread plate 14 and progressively move inward until another repeating pattern (not shown) is needed or desired.

Referring to FIG. 6 and the exploded view of FIG. 6A, a connecting tread assembly 62 is provided for connecting the first tread assembly repeating pattern 80 to the second tread assembly repeating pattern 82. The connecting tread assembly 62 includes a connecting tread plate 64 and a first and second pair of connecting telescoping support members 66 and 68. The first pair of connecting telescoping support members 66 engage the third pair of telescoping support members 56 of the third tread assembly 52 so that the height of the connecting tread plate 64 is adjustable with respect to the third tread plate 54. The second repeating pattern 82 includes a fourth tread assembly 72 (i.e., the bottom tread assembly of the second repeating pattern) having a fourth tread plate 74 and a fourth pair of first and second telescoping support members 76. The second pair of connecting telescoping support members 68 engage the fourth pair of telescoping support members 76 of the fourth tread assembly 72 so that the height of the fourth tread plate 74 is adjustable with respect to the connecting tread plate 64.

Figures 7, 7A:
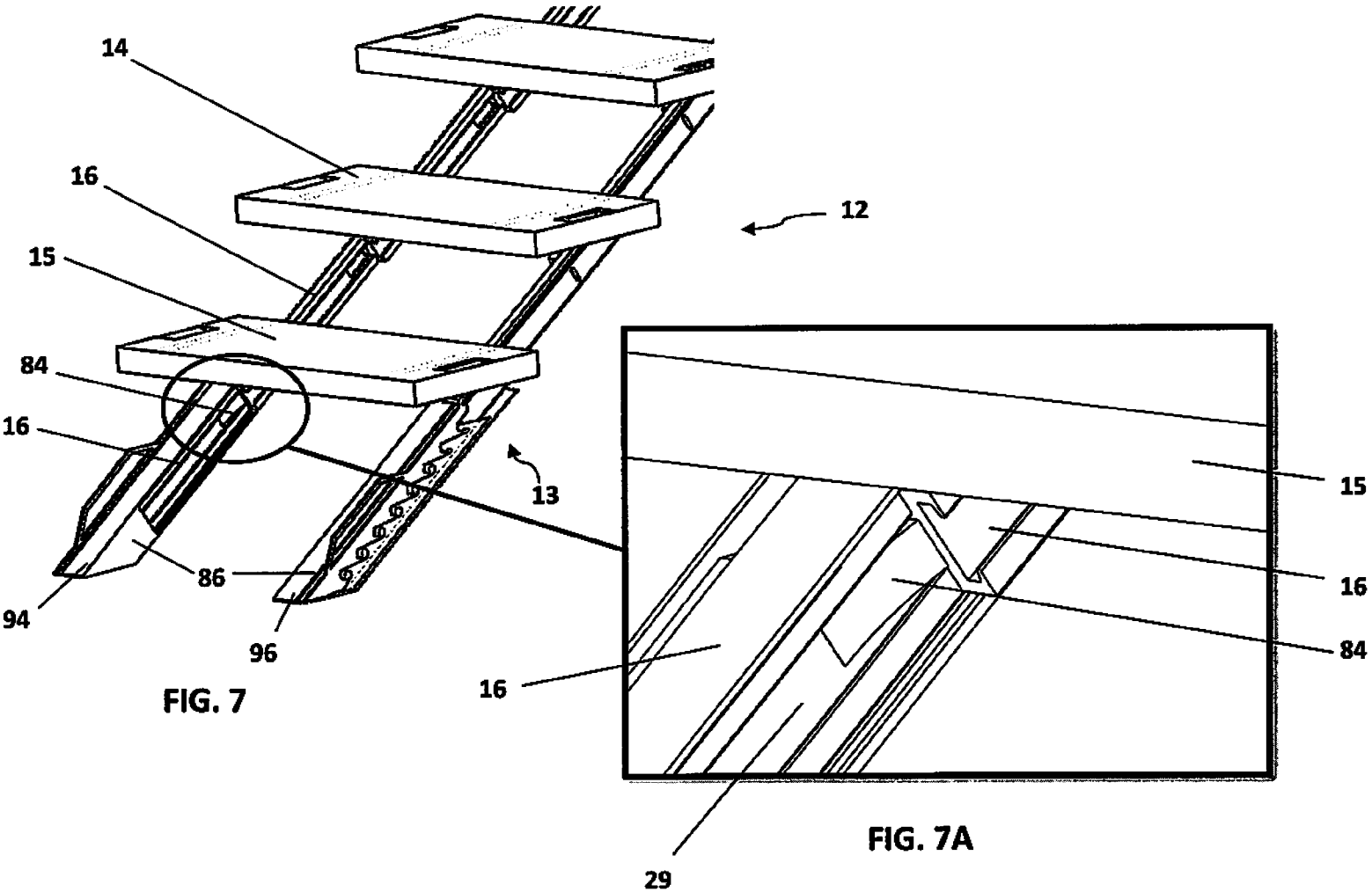
FIG. 7 depicts a perspective view of a lower portion of a staircase according to one embodiment of the present invention.
FIG. 7A depicts an exploded perspective view of the locking mechanism of the tread assemblies according to one embodiment of the present invention.

As shown in FIGS. 7 and 7A, means are provided on each of the telescoping support members 16 for locking each of the tread assemblies 12 in an extended position (as shown in FIG. 7) and unlocking the tread assemblies 12 to move them to a collapsed position (as shown in FIGS. 2 and 3). Further, the means for individually locking/unlocking the tread plate positioning allows for each tread plate 14, as explained above, to be operable to collapse independently of another one of the tread plates so that the height of the staircase 10 is incrementally adjustable. While many slide locking mechanisms are known in the art and within the scope of the invention, such as a spring plunger, cam action, or pin locking systems, the locking system for the telescoping support members 16 of the present invention is preferably a spring locking detent type system. Each of the telescoping support members 16 includes a spring loaded detent 84 (as also shown in FIGS. 4-5) disposed in the female receiving surfaces 29 (i.e., inside surface) of the telescoping support members 16. Referring to FIG. 7, as tread assembly 12 is extended from a bottom adjacent tread assembly 13 having tread plate 15, the spring loaded detents 84 of the bottom adjacent tread assembly 13 pop out of its recesses and prevent the male engaging surfaces 28 of tread assembly 12 from any further sliding movement within the female receiving surfaces 29 of the adjacent tread assembly 13. To unlock the tread assembly 12, one pushes in on the spring loaded detent 84 to allow the male engaging surface 28 to slide freely along the female engaging surface of the bottom adjacent tread assembly 13 until the tread assembly 12 is slides into a collapsed position where tread plate 14 is disposed on top of tread plate 15.

Figure 8A:
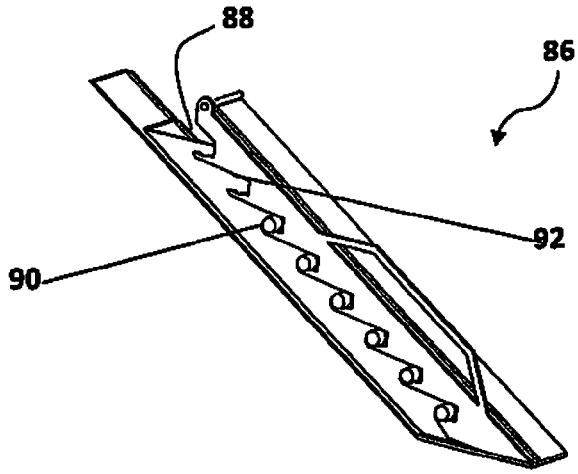
FIGS. 8A-8C depict perspective views of a leveling mechanism according to one embodiment of the present invention.
Figure 8B:
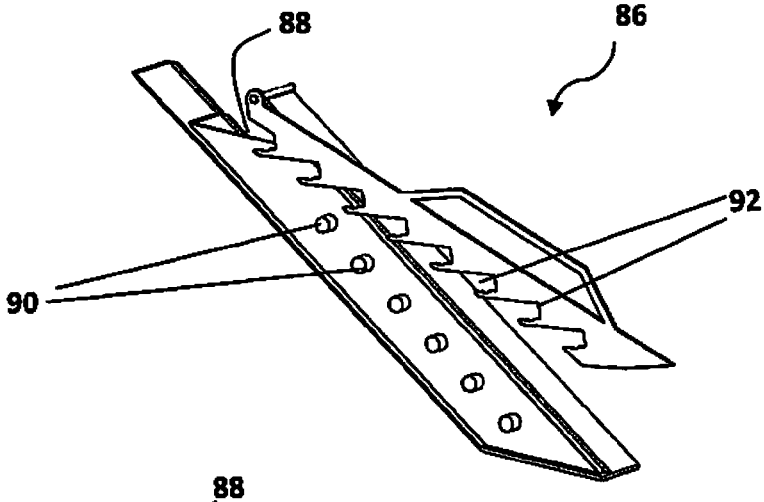
Figure 8C:
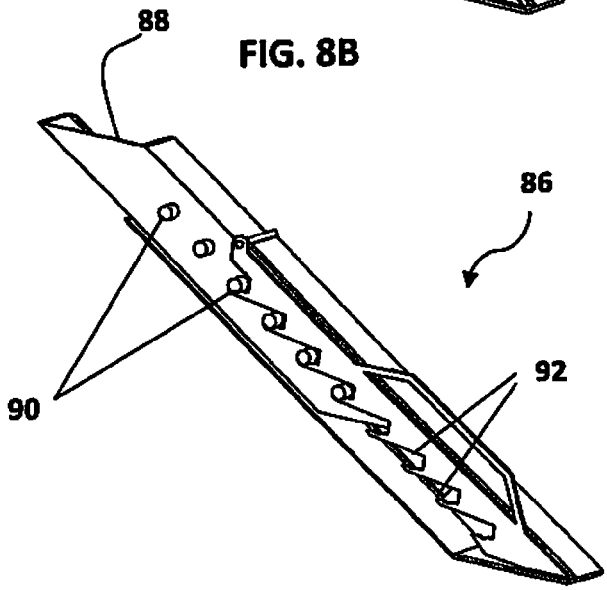

As shown in FIG. 7, the staircase 10 preferably includes a first and second leveling mechanism 86 attached to each of the telescoping support members 16 of a bottom tread assembly 13 of the staircase 10. Referring to FIGS. 8A-8C, the leveling mechanisms 86 preferably includes an aperture 88 for receiving the telescoping support members 16 of the bottom tread assembly 13 and a plurality of tab elements 90 for engaging a plurality of leveling slots 92 so that the length of at least one of a first side and a second side 94 and 96 (as shown in FIG. 7) of the staircase 10 can be adjusted with respect to the ground surface 11. For example, if the ground surface 11 is lower where the first side 94 of the staircase 10 contacts the ground than where the second side 96 contacts the ground, the leveling mechanism 86 attached to the first side 94 of the staircase 10 can increase the length of the first side 94 as shown by the process in FIGS. 8A-8C so that the tread plates 14 remain in a substantially zero degree angle in the horizontal plane during use of the staircase 10. In some embodiments, casters may be included on the leveling mechanism 86 to increase mobility of the staircase 10. While one type of leveling mechanism 86 has been shown for use with the staircase 10, many other types of leveling mechanisms are possible such as threaded leveling mounts and leveling casters.

The leveling mechanisms 86 also serve as a fine tuning adjustment for the overall height of the staircase 10. For example, if both leveling mechanisms 86 are moved the same number of adjustments, the staircase 10 will increase or decrease a small increment in overall height.

Figure 9A:
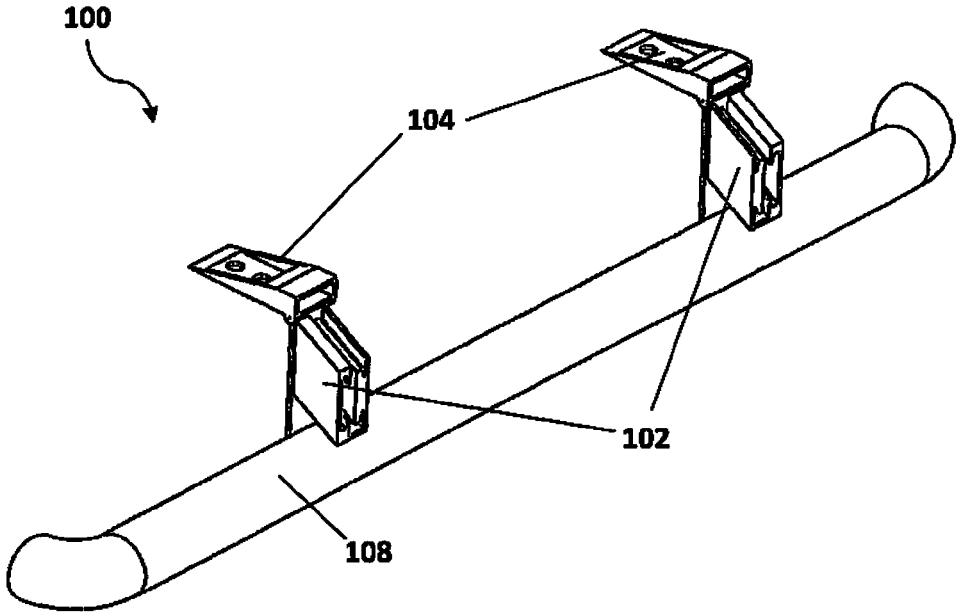
FIGS. 9A-9F depict perspective views of various mounting assemblies for the staircase according to embodiments of the present invention.
Figure 9B:
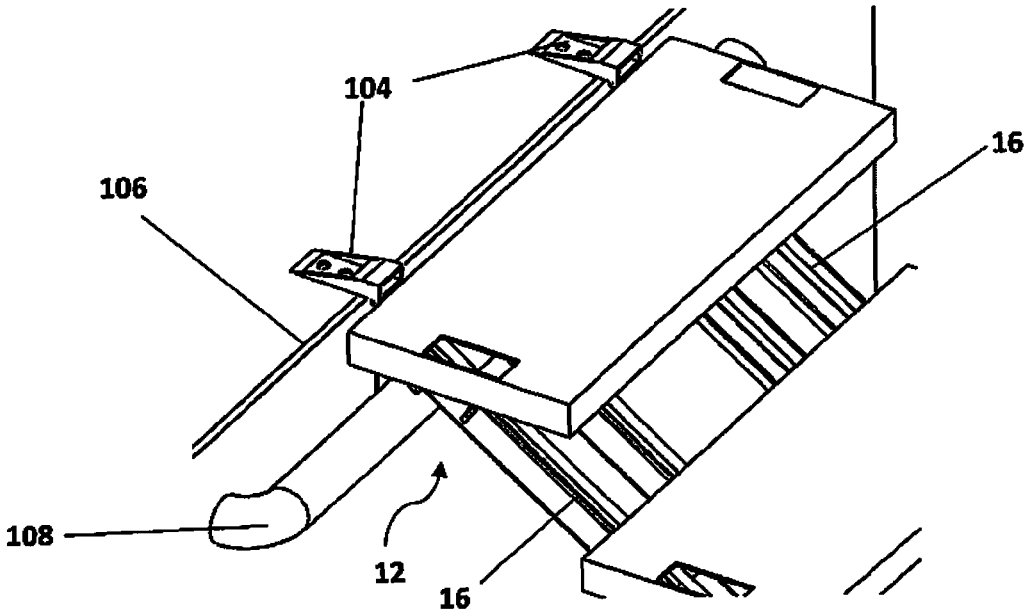
Figure 9C:
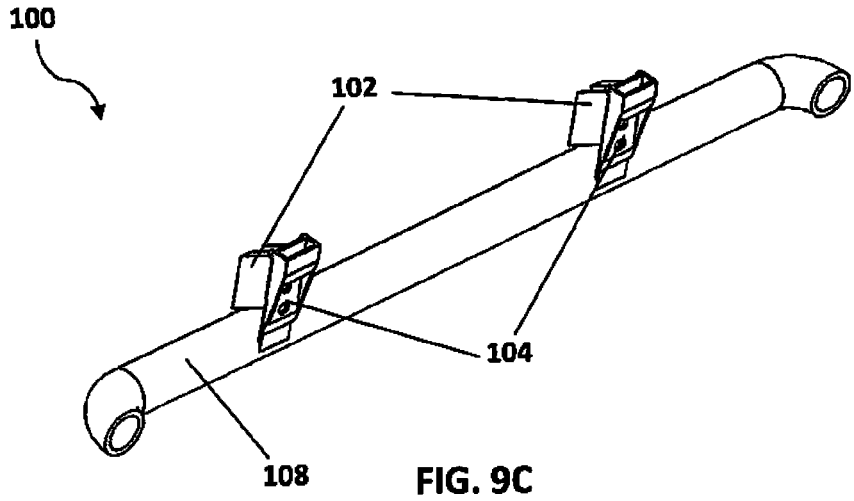
Figure 9D:
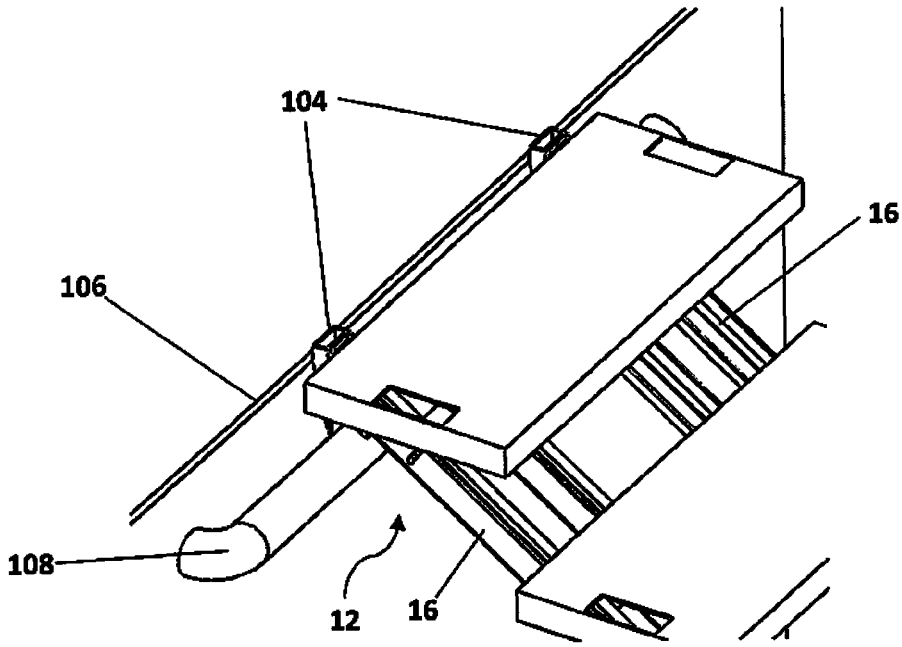
Figure 9E:
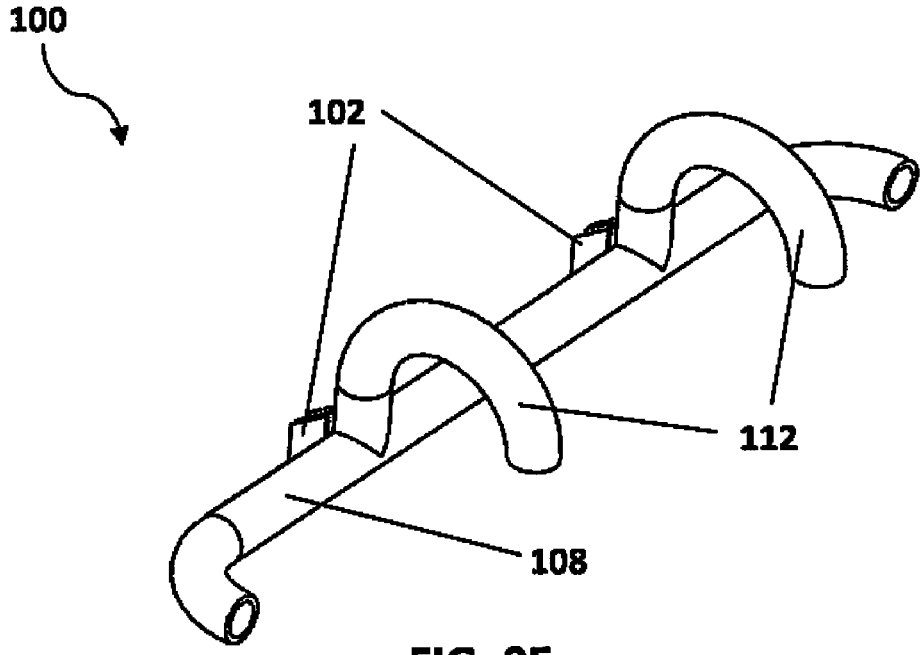
Figure 9F:
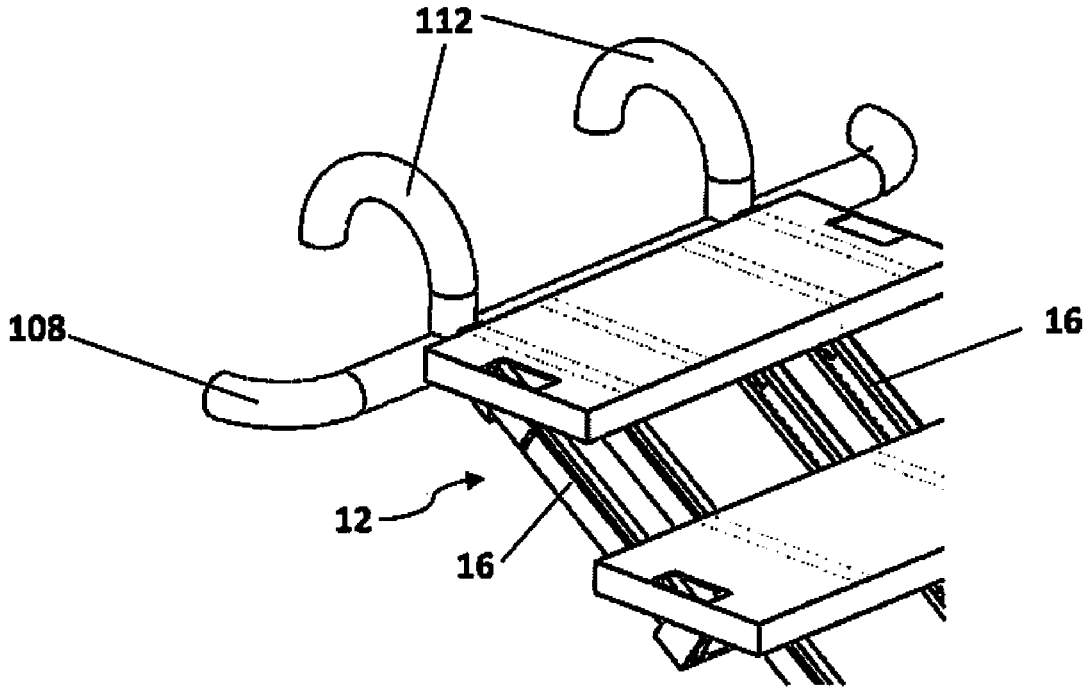

Staircase 10 is designed so that it is independently moveable from location to location. In other words, staircase 10 is able to be moved from a first location to a second location without having to move the particular structure the staircase was attached to at the first location. Also, while staircase 10 is designed to be able to free stand against a vertical structure in a stabilized manner similar to the way a common extension ladder freely rests against a structure such as a roof, staircase 10 is also designed so that it can be mounted or secured to a desired location either on a semi-permanent or a short-term basis. Referring to FIGS. 9A-9F, various mounting assemblies 100 are shown for securing the staircase 10 at the desired location. For example, the mounting assembly 100 as shown in FIGS. 9A-9D includes a first and second support attachment 102 for engaging respective first and second telescoping support members 16 of a top tread assembly 12 to secure the mounting assembly 100 to the staircase 10. Mounting brackets or hinges 104 may be provided for securing the mounting assembly 100 to the desired mounting location 106. A mounting support 108 may also be provided for securing adjacent the desired location 106 beneath the first and second telescoping support members 16 of the top tread assembly 12 for providing extra support to the staircase 10. In another embodiment, the mounting assembly 110 shown in FIGS. 9E-9F is designed having hook members 112 for mounting the staircase 10 on a short-term basis.

Figure 10:
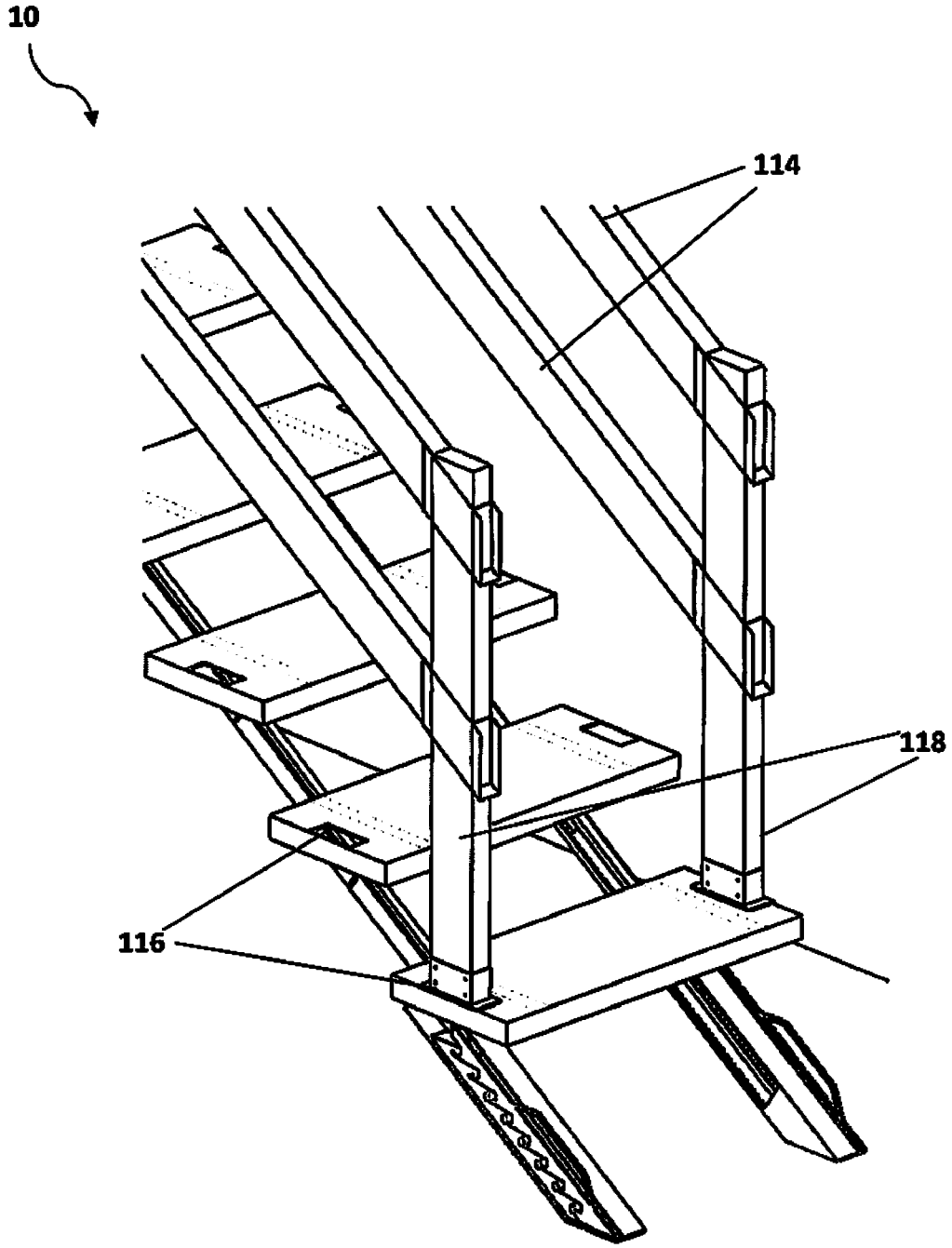
FIG. 10 depicts a perspective partial view of a collapsible staircase having a handrail according to one embodiment of the present invention.
Figure 11:
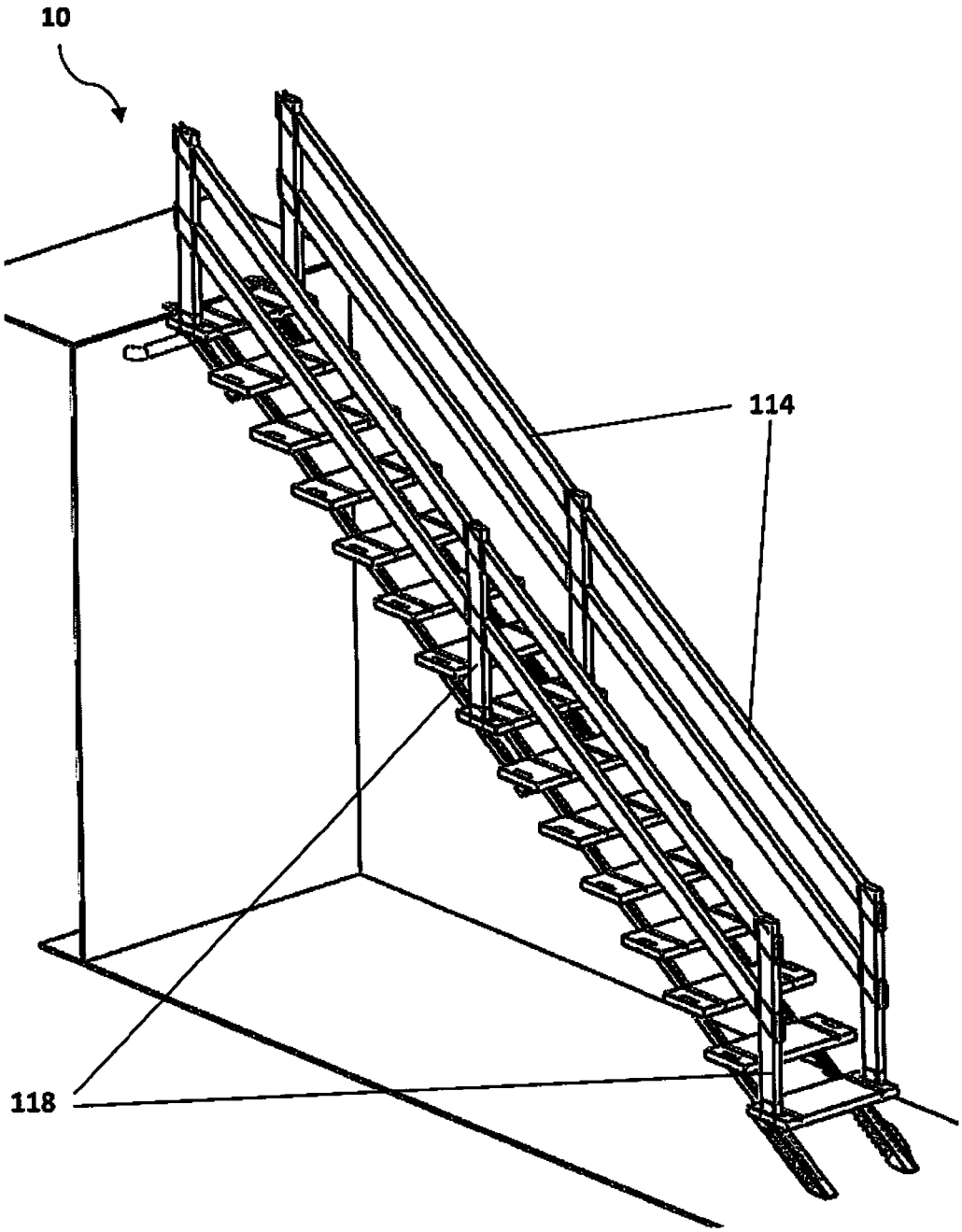
FIG. 11 depicts a perspective view of a collapsible staircase having a handrail according to one embodiment of the present invention.

In another aspect of the invention, a handrail 114 may be included with the staircase 10 as shown in FIGS. 10-11. Referring to FIGS. 4 and 11, at least a plurality of tread plates 14 include slots 116. The slots 116 are intended to accept the legs 118 of handrail 114. As shown, the handrail 114 may simply be 2×4's nailed together, 2×4's with affixed brackets for a more secure railing, or an accessory (such as a Tensabarrier® type rail) that can integrate into the compact nature of the staircase. The slots 116 are intended to accept these and other types of handrails 114. If the staircase 10 is intended to be used for a short project, a handrail may not need to be installed. However, if the staircase 10 is installed in a semi permanent application, then it may be necessary or advised to add a handrail due to heavy traffic (i.e. at a construction site).

The foregoing description of preferred embodiments for this invention has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention.

What is claimed is:

1. A collapsible staircase having at least two repeating pattern tread assemblies, comprising:

a first tread assembly including at least one first tread plate and a pair of telescoping support members attached to a rear surface along a width of the first tread plate;

a second tread assembly including at least one second tread plate and a pair of telescoping support members attached to a rear surface along a width of the second tread plate;

a connecting tread assembly including a tread plate and a first pair of telescoping support members attached to a rear surface along a width of the connecting tread plate for slidably engaging the first tread assembly pair of telescoping support members so that a height of the connecting tread assembly is adjustable with respect to the first tread assembly;

the connecting tread assembly having a second pair of telescoping support members attached to a rear surface along a width of the connecting tread plate for slidably engaging the second tread assembly pair of telescoping support members so that a height of the connecting tread assembly is adjustable with respect to the second tread assembly; and the connecting tread assembly connecting the first tread assembly to the second tread assembly in a collapsible staircase.

2. The collapsible staircase according to claim 1 wherein each of the at least two repeating pattern tread assemblies have a height that is incrementally adjustable and defines a substantially fixed angle between the tread plates of each of the tread assemblies when connected by the connecting tread assembly.

3. The collapsible staircase according to claim 1 wherein each of the telescoping support members have a male engaging surface and a female receiving surface for slidably engaging the first and second telescoping support members of an adjacent tread assembly.

4. The collapsible staircase according to claim 1 wherein each of the telescoping support members include a spring loaded detent disposed on an inside surface of the telescoping support members, the spring loaded detents for removably locking the tread assemblies so that each tread assembly is operable to collapse independently of any of the other tread plates.

5. The collapsible staircase according to claim 1 wherein one of the repeating pattern tread assemblies further comprises a top tread assembly having a top pair of telescoping support members and the collapsible staircase further comprises a mounting assembly for securing the staircase to a desired location, the mounting assembly including a first and a second support attachment for engaging the top pair of first and second telescoping support members of the top tread assembly, the first and second support attachments being attachable to a mounting bracket disposed adjacent the desired location.

* * * * *